US009487909B2

(12) United States Patent
Arcarons Alibés et al.

(10) Patent No.: US 9,487,909 B2
(45) Date of Patent: Nov. 8, 2016

(54) TUMBLE DRYER WITH A SUCTION-ASSISTED LOADING DEVICE

(71) Applicant: GIRBAU S.A., VIC—Barcelona (ES)

(72) Inventors: Daniel Arcarons Alibés, Barcelona (ES); Jordi Garcia Ferrera, Barcelona (ES); Julian Muriel Luna, Barcelona (ES)

(73) Assignee: GIRBAU, S.A., VIC (Barcelona) (ES)

( * ) Notice: Subject to any disclaimer, the term of this patent is extended or adjusted under 35 U.S.C. 154(b) by 263 days.

(21) Appl. No.: 14/384,175

(22) PCT Filed: Apr. 19, 2013

(86) PCT No.: PCT/IB2013/000744

§ 371 (c)(1),
(2) Date: Sep. 10, 2014

(87) PCT Pub. No.: WO2013/164672

PCT Pub. Date: Nov. 7, 2013

(65) Prior Publication Data

US 2015/0040417 A1 Feb. 12, 2015

(30) Foreign Application Priority Data

May 4, 2012 (EP) ..... 12380021

(51) Int. Cl.

| | |
|---|---|
| ***D06F 58/10*** | (2006.01) |
| ***D06F 58/04*** | (2006.01) |
| ***D06F 58/20*** | (2006.01) |

(52) U.S. Cl.
CPC ..... *D06F 58/10* (2013.01); *D06F 58/04* (2013.01); *D06F 58/20* (2013.01)

(58) Field of Classification Search
CPC ..... D06F 58/10; D06F 58/04; D06F 58/20
See application file for complete search history.

(56) References Cited

U.S. PATENT DOCUMENTS

| | | | |
|---|---|---|---|
| 5,060,399 | A | 10/1991 | Engel |
| 6,094,763 | A | 8/2000 | Engel |
| 2012/0096733 | A1 | 4/2012 | Sans Rovira et al. |

FOREIGN PATENT DOCUMENTS

| | | | |
|---|---|---|---|
| DE | 25 13 660 | A1 | 10/1975 |
| DE | 196 25 707 | A1 | 1/1998 |
| EP | 2 436 830 | A1 | 4/2012 |
| GB | 1472351 | A | 4/1977 |
| WO | WO 2013/164672 | A1 | 11/2013 |

*Primary Examiner* — Jiping Lu

(74) *Attorney, Agent, or Firm* — Hess Patent Law Firm; Robert J. Hess

(57) ABSTRACT

The tumble dryer includes a rotary drum (1), a suction turbine (5) in communication with air inlets and outlets (3, 6) at opposite ends of the drum to create an axial drying air flow, and an unloading door (7) with a loading opening (8) formed therein. The turbine creates a suction air flow in a loading duct (9) connected to the loading opening (8) during a suction-assisted clothes loading operation, and moves the clothes loaded inside the drum (1) away from the air outlets (6) and/or for temporarily provides an auxiliary air exit in communication with the suction turbine (5) during suction-assisted clothes loading to assure enough suction air flow for that purpose.

11 Claims, 9 Drawing Sheets

TUMBLE DRYER WITH A SUCTION-ASSISTED LOADING DEVICE

FIELD OF THE ART

The present invention generally relates to a tumble dryer with a suction-assisted loading device, and more particularly to an industrial tumble dryer provided with a clothes loading device assisted by an air suction created in a clothes loading duct by the same suction turbine used to circulate the drying air.

BACKGROUND OF THE INVENTION

Tumble dryers with a suction-assisted clothes loading device, which are provided with a drum arranged to be rotated by driving means around a horizontal or slightly inclined rotation axis, are known, where the drum has a revolution wall for containing a load of clothes to be dried, an open loading and unloading end and a back end opposite said loading and unloading end.

These known tumble dryers have at least one drying air intake opening arranged in communication with at least one drying air inlet for the entry of air into the drum, a suction turbine in communication with a plurality of air outlets for extracting air from the drum, and an unloading door that is movable between an open position in which the unloading door allows the exit of clothes through the loading and unloading end of the drum, and a closed position in which the unloading door is facing said loading and unloading end of the drum preventing the exit of clothes through it.

Clothes to be dried are loaded into the drum through a loading opening formed in said unloading door and arranged in a position facing the loading and unloading end of the drum when the door is closed, and said loading opening is connected to a clothes loading duct having a loading mouth in a position that can be comfortably accessed by an operator.

The loading device further includes a first shutter for opening and closing the air flow communication between the drying air intake opening and the inside of the drum, a second shutter for opening and closing the air flow communication between the loading opening and the loading duct, and driving and control means for closing said first shutter and opening said second shutter while the mentioned suction turbine is operating to create a suction air flow in said clothes loading duct assisting the operator in the operation of loading the clothes to be dried into the drum.

Thus, the operator only has to place the items of clothing to be dried close to the loading mouth of the loading tube and the suction air flow completes the loading into the drum by suction.

Nevertheless, this suction loading device is not directly applicable to another type of axial-flow tumble dryer such as that described in international patent application WO 2010/136610, which comprises a rotary drum around a horizontal or slightly inclined rotation axis, where the drum has a non-perforated revolution wall, an open loading end and an also open unloading end opposite said loading end, and where the drying air inlet is in a non-rotational part and facing either the loading end or the unloading end of the drum and said air outlets are in a non-rotational part and facing the other opposite end of the drum, either the unloading end or the loading end.

The tumble dryer described in the aforementioned international patent application WO 2010/136610 has a high drying efficiency due to the fact that the air outlets are located at a level below the rotation axis of the drum, such that the axial air flow created by the suction turbine during drying is forced through the clothes which are being dried tumbling in the lower part of the inside of the drum as a result of the rotation thereof at a speed less than 1 G during drying.

If the suction-assisted loading device of the state of the art is applied to an axial-flow dryer such as the one described in the aforementioned international patent application WO 2010/136610, once the clothes to be dried are introduced in the drum through the loading opening, they would fall due to gravity onto the lower part of the inside of the drum and be pulled by the suction air flow to the non-rotational part where the air outlets are located, and given that these openings are located at a level below the rotation axis, the air outlets would be blocked by the first items of clothing to be dried loaded into the drum and this would interrupt the suction air flow and stop the suction-assisted loading operation.

An objective of the present invention is to provide an axial-flow tumble dryer with a suction-assisted loading device that is provided with means for preventing the drawback described above.

DESCRIPTION OF THE INVENTION

The present invention contributes to achieving the foregoing and other objectives by providing a tumble dryer with a suction-assisted loading device, comprising a rotary drum, and provided with a non-perforated revolution wall, an open loading and unloading end and an also open back end opposite said loading and unloading end, and rotation driving means for rotating said drum around a horizontal or slightly inclined rotation axis.

The tumble dryer of the present invention further comprises at least one drying air intake opening in communication with at least one drying air inlet, which is facing the loading and unloading end of the drum to introduce drying air into said drum, a suction turbine in communication with a plurality of air outlets facing the back end of the drum and located at a level below said rotation axis in the back end to extract drying air from inside the drum, such that during drying, said suction turbine creates a drying air flow in a substantially axial direction inside the drum from the loading and unloading end to the back end.

The tumble dryer of the present invention further comprises an unloading door that is movable between an open position and a closed position facing said loading and unloading end of the drum, a loading opening formed in said unloading door in a position facing the loading and unloading end of the drum when the unloading door is closed, and a clothes loading duct connected to said loading opening and provided with a loading mouth.

To perform the suction-assisted loading operations, the tumble dryer further comprises a first shutter for opening and closing the communication between said drying air intake opening and the inside of the drum, and a second shutter for opening and closing said loading opening, and means for closing said first shutter and opening said second shutter while the suction turbine is operating to create a suction air flow in said clothes loading duct that is enough to assist in loading clothes into the drum through said loading mouth.

The tumble dryer of the present invention further comprises means for moving the clothes loaded inside the drum away from the air outlets during suction-assisted clothes loading and/or means for temporarily providing an auxiliary air exit in communication with the suction turbine in addition to the air outlets during suction-assisted clothes loading to assure a suction air flow that is enough to entrain the clothes from the loading mouth into the drum.

In one embodiment of the mentioned means for moving the clothes loaded inside the drum away from the air outlets during suction-assisted clothes loading, the tumble dryer comprises control means in connection with said rotation driving means for rotating the drum at a speed equal to or greater than 1 G during suction-assisted clothes loading. Thus, once an item of clothing enters the drum through the loading opening, it falls due to gravity onto the lower part of the revolution wall of the drum and is pulled upwards by the latter due to the effect of the rotation of the drum.

Since the rotational speed of the drum is equal to or greater than 1 G, the clothes adhere to the inner surface of the revolution wall of the drum and do not accumulate in the lower part against the air outlets located at a level below the rotation axis, such that the air outlets are clear, allowing the extraction of air through it during the entire suction-assisted loading operation.

Thus, by moving the clothes loaded inside the drum away from the air outlets by means of a rotation of the drum at a speed equal to or greater than 1 G, the suction air flow created by the turbine through the air outlets is enough to entrain the items of clothing fed by an operator from the loading mouth along the loading duct and into the drum.

In one embodiment of the mentioned means for providing an auxiliary air exit during suction-assisted clothes loading, the tumble dryer comprises one or more auxiliary air outlets in communication with the suction turbine, a third shutter for opening and closing the communication between said one or more auxiliary air outlets and the suction turbine, and means for opening said third shutter during suction-assisted clothes loading and for closing the third shutter during drying. Here, the suction-assisted clothes loading operation can be performed with the drum stopped or rotating at a speed less than, equal to or greater than 1 G.

The mentioned one or more auxiliary air outlets can be facing either the loading and unloading end or the back end of the drum, or there can even be one or more auxiliary air outlets facing the loading and unloading end of the drum and one or more auxiliary air outlets facing the back end of the drum.

Since the air outlets and the auxiliary air outlets jointly have a relatively large exit area, the speed of the suction air flow through the air outlets and auxiliary air outlets is relatively low and is not enough to pull the items of clothing.

In one variant of this embodiment, the one or more auxiliary air outlets are installed in a position facing the back end of the drum and located at a level above the rotation axis. The suction air flow inside the drum is thus distributed between the air outlets located at a level below the rotation axis and the auxiliary air outlets located at a level above the rotation axis. Even if one of the items of clothing is pulled by the suction air flow along the lower part of the revolution wall of the drum and eventually covers the air outlets located at a level below the rotation axis, the one or more auxiliary air outlets located at a level above the rotation axis would still be clear assuring a suction air flow that is enough to entrain the clothes from the loading mouth along the loading duct and into the drum.

In another variant of this embodiment, the tumble dryer comprises a communication between the drying air inlet and the suction turbine, and in this case the third shutter is arranged for opening and closing said communication between the drying air inlet and the suction turbine, which allows using the drying air inlet as the mentioned auxiliary air outlet when the first shutter is closed and the third shutter is open, which simplifies the construction of the tumble dryer.

In any of the two variants described, once the clothes are loaded into the drum, the third shutter closes the one or more auxiliary air inlets such that during drying, the tumble dryer maintains the high drying efficiency provided by the plurality of air outlets located at a level below the rotation axis.

It must be pointed out that the mentioned means for moving the clothes loaded inside the drum away from the air outlets during suction-assisted clothes loading and the mentioned means for temporarily providing an auxiliary air exit in communication with the suction turbine in addition to the air outlets during suction-assisted clothes loading are compatible and can coexist in one and the same embodiment of the tumble dryer of the present invention.

The tumble dryer of the present invention preferably has an automatic unloading device comprising helical fins fixed internally in the revolution wall of the drum and control means in connection with the rotation driving means for rotating the drum in a suitable direction so that said helical fins pull the clothes inside the drum towards the loading and unloading end during a clothes unloading operation for unloading clothes from inside the drum while the unloading door is in the open position.

Optionally, the rotation axis of the drum is slightly inclined with respect to the horizontal such that the loading and unloading end of the drum is at a lower level than the back end, which favors the tendency of the clothes to slip due to gravity towards the loading and unloading end of the drum, which tendency during drying, is compensated for by means of the thrust caused by the axial drying air flow.

Alternatively or additionally, the revolution wall of the drum is frustoconical or frustoconical-like, such that the generatrixs profile of the revolution wall in the lowest position of the drum has its end adjacent to the loading and unloading end at a lower level than its end adjacent to the back end.

The tumble dryer of the present invention has an outer casing in which the drum and communication ducts between the drying air intake opening and the drying air inlet and between the suction turbine and the air outlets are located. Given that the revolution wall of the drum has no perforations, the tumble dryer does not need an enveloping cover around the drum.

The outer casing has a front wall in which the unloading door is installed, and a rear wall, and dynamic sealing gaskets are arranged between the loading and unloading end of the drum and the front wall of the outer casing and between the back end of the drum and the rear wall of the outer casing. The unloading door, which has the loading opening formed therein which in turn is connected to the loading duct, is a swinging door connected to the front wall of the outer casing by a horizontal hinge in its upper edge, or alternatively a guillotine door connected to the front wall of the outer casing by vertical side guides.

Given that the loading duct moves with the unloading door, the loading mouth is formed in an auxiliary protective casing fixed to the outer casing in a stationary position, and the loading duct has an end section connected to this auxiliary protective casing by horizontal guides such that it can be moved towards one side from an operating position, in which the end section communicates the loading mouth with the loading duct, to a retracted position in which the end section does not interfere with the loading duct when the unloading door is moved from the closed position to the open position.

When the unloading door is in the closed position, the end section of the loading duct is again moved to the operating position and automatically couples with the loading duct. A closure plate which moves together with the end section of the loading duct closes the loading mouth when the end section of the loading duct is in the retracted position. As an additional safety measure, the tumble dryer has a control panel with two separate unloading opening buttons which must be pushed with both hands to command the movement of the end section of the loading duct to its retracted position and the opening of the unloading door.

The loading opening is preferably in a position very close to the lower part of the revolution wall of the drum and the loading duct is preferably straight. The end section of the loading duct forms a slight bend enough to only provide a loading mouth inclined approximately 45 degrees with respect to the vertical. When the unloading door is closed, the loading duct preferably adopts a horizontal or close to horizontal position, which helps the operator feed the items of clothing into the loading mouth and requires a moderate suction force from the suction turbine to assist in clothes loading by suction.

Thus, in a preferred embodiment, the tumble dryer of the present invention has a suction-assisted loading device and a completely automatic unloading device.

BRIEF DESCRIPTION OF THE DRAWINGS

The foregoing and other features and advantages will be better understood from the following detailed description of several embodiments with reference to the attached drawings, in which.

DETAILED DESCRIPTION OF EXEMPLARY EMBODIMENTS

Figure 1:
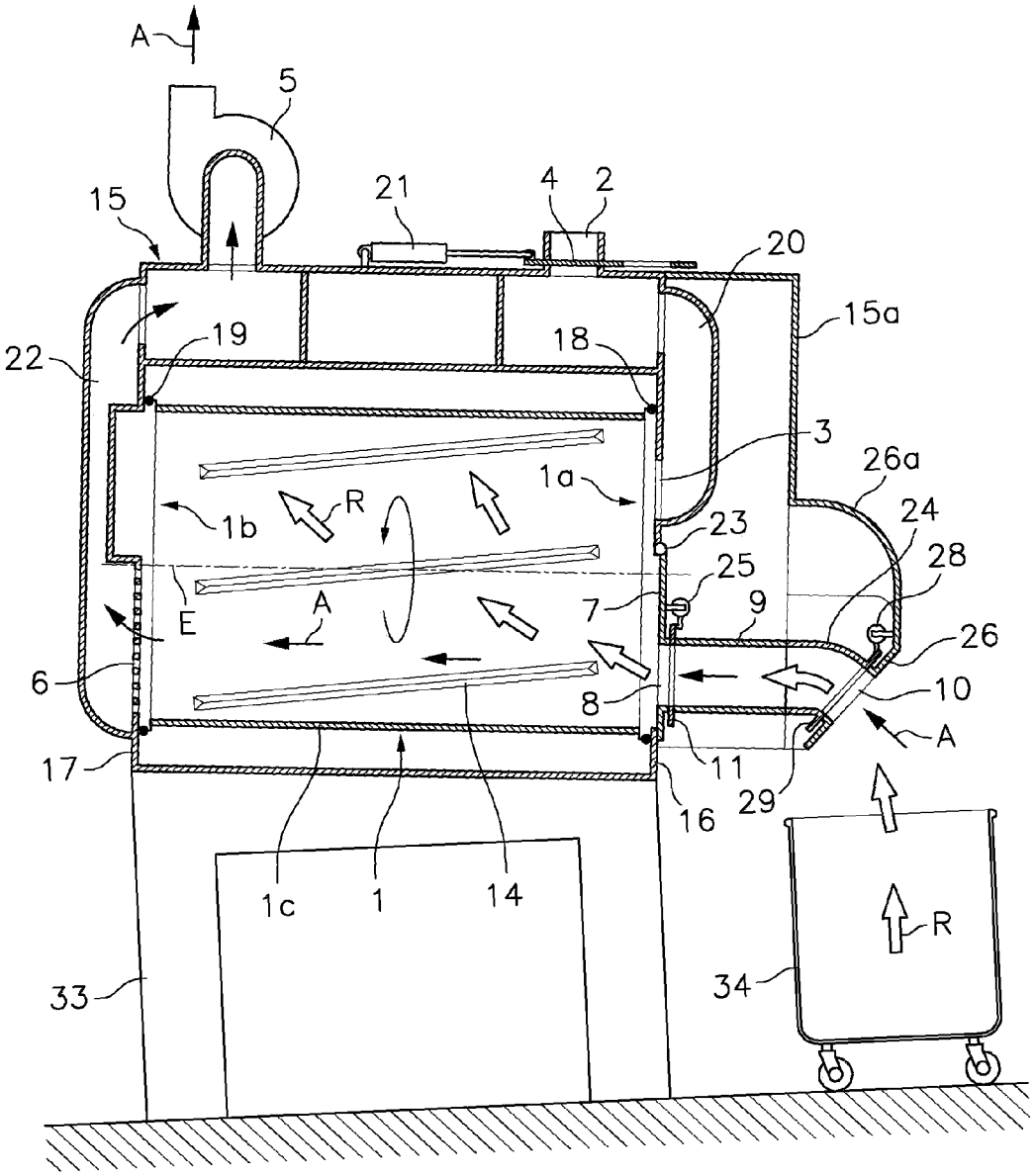
FIG. 1 is a schematic sectioned side view of a tumble dryer with a suction-assisted loading device according to an embodiment of the present invention during a suction-assisted clothes loading operation.
Figure 2:
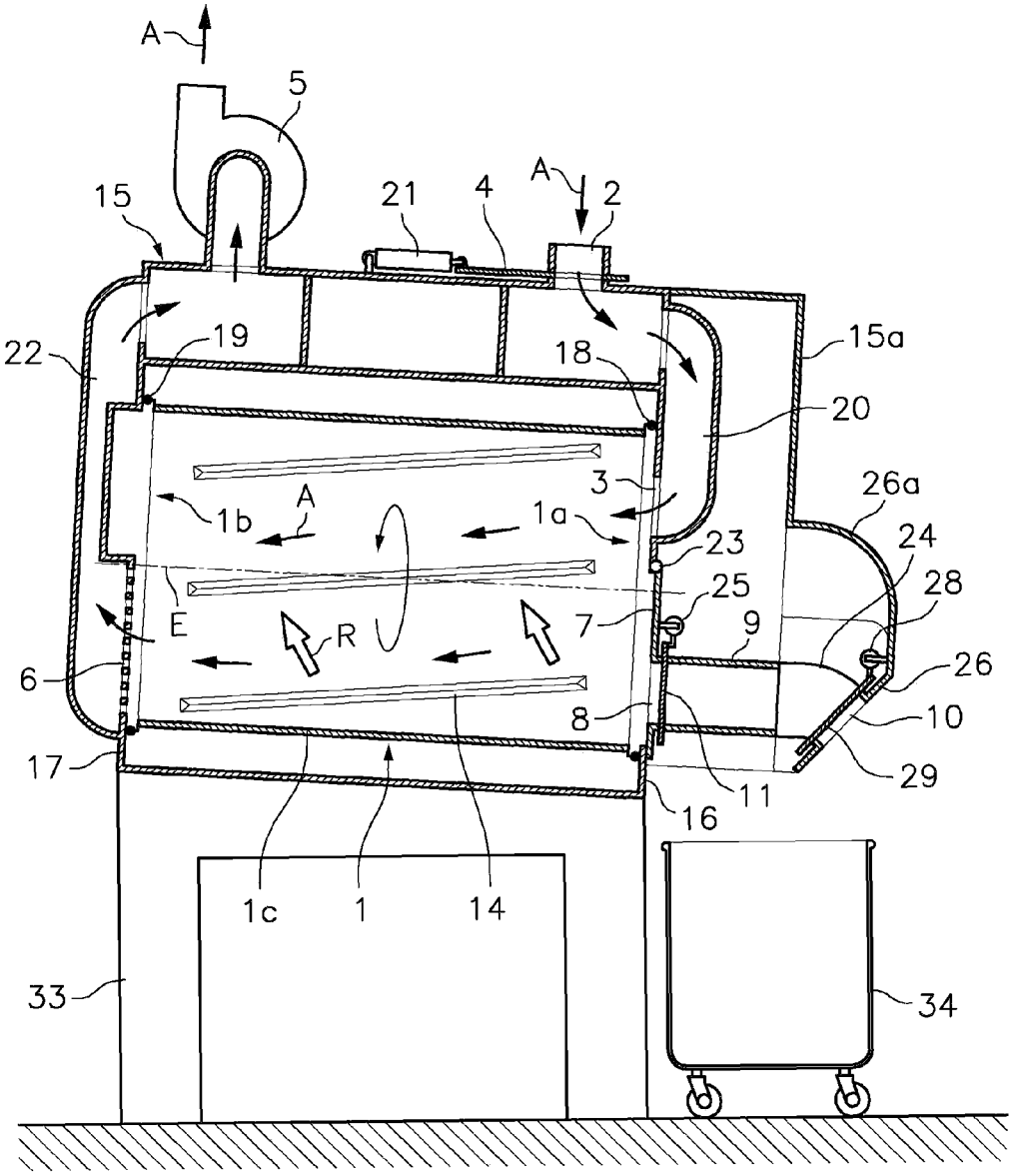
FIG. 2 is a schematic sectioned side view of the tumble dryer of FIG. 1 during a drying operation.
Figure 3:
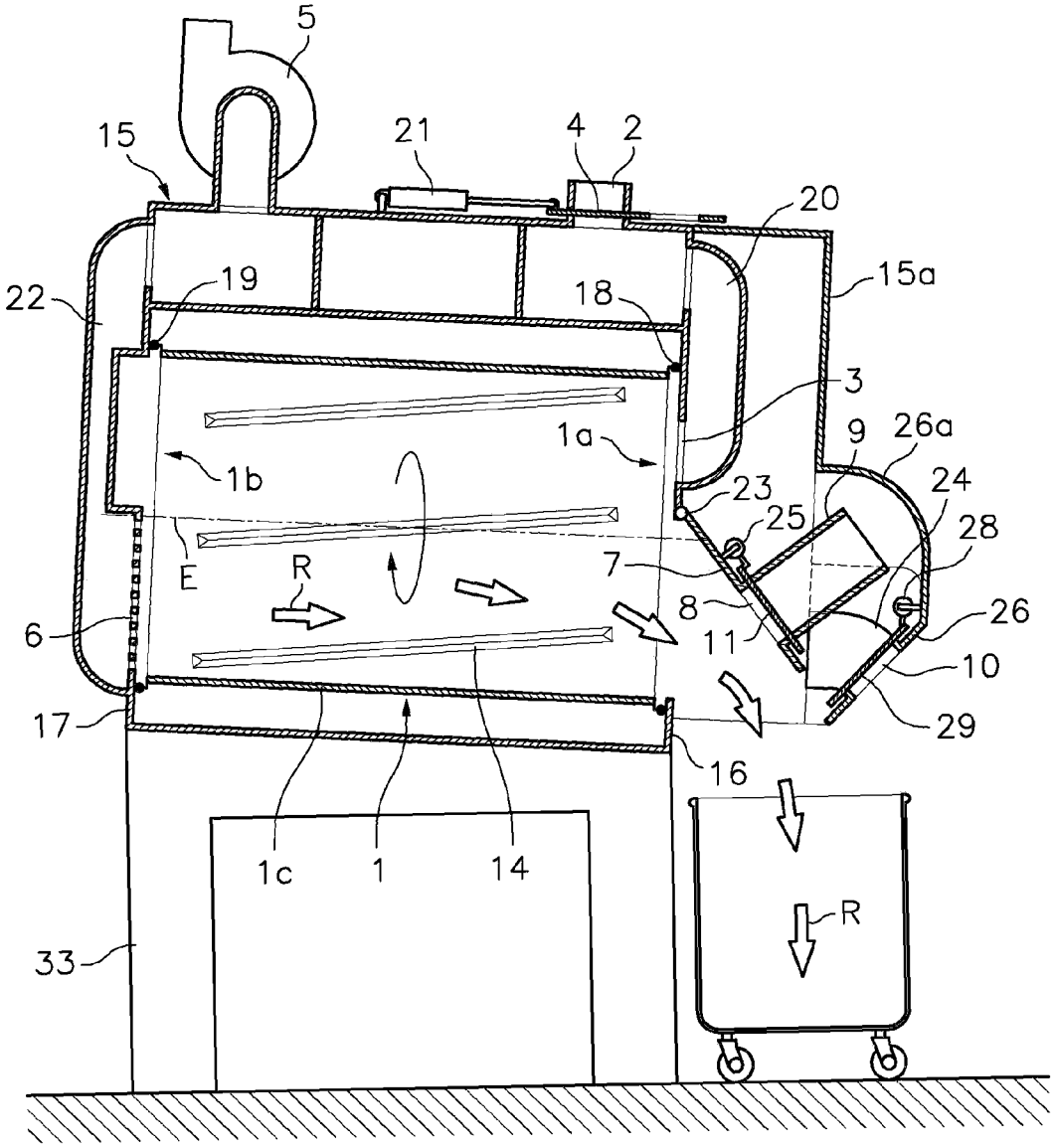
FIG. 3 is a schematic sectioned side view of the tumble dryer of FIG. 1 during an automatic clothes unloading operation.

First in reference to FIGS. 1, 2 and 3, said figures show a tumble dryer with a suction-assisted loading device, which comprises an outer casing 15 inside of which there is housed a rotary drum 1 having a non-perforated revolution wall 1*c*, an open loading and unloading end 1*a* and an open back end 1*b* opposite said loading and unloading end 1*a*. Rotation driving means (not shown) are operatively connected for rotating the drum 1 around a slightly inclined rotation axis E, such that the loading and unloading end 1*a* of the drum 1 is at a lower level than the back end 1*b*.

The outer casing 15 has a front wall 16 and a rear wall 17. A sealing gasket 18 is arranged between the loading and unloading end 1*a* of the drum 1 and the front wall 16 of the outer casing 15, and another sealing gasket 19 is arranged between the back end 1*b* of the drum 1 and the rear wall 17 of the outer casing 1.

These sealing gaskets 18, 19 provide a relative tightness with respect to the air in the inner space of the drum 1 when the drum 1 is stopped and when the drum 1 is rotating, and will be explained in further detail below in relation to FIGS. 11, 12 and 13.

In an upper part of the outer casing 15 there is a drying air intake opening 2, which is in communication through a first air duct 20 with a drying air inlet 3 located in the front wall 16 of the outer casing 15, in a position facing the loading and unloading end 1*a* of the drum 1, such that the drying air is introduced into the drum 1 through said drying air inlet 3.

The drying air intake opening 2 is associated with a first shutter 4 actuated by a first actuator 21 opening and closing the communication between the drying air intake opening 2 and the drying air inlet 3.

Figure 6:
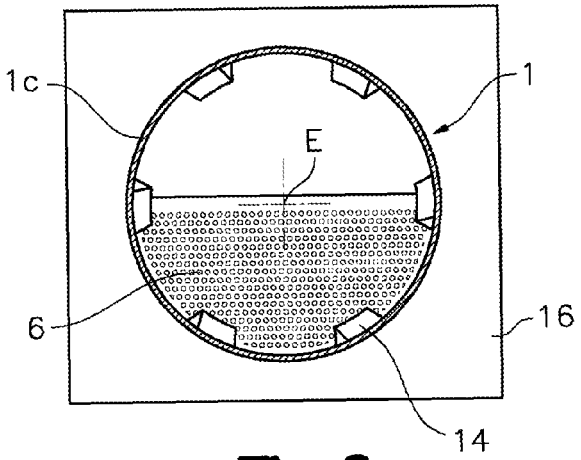
FIG. 6 is a cross-section view of the drum with the back wall of the outer casing of the tumble dryer of FIG. 1.

A suction turbine 5, which is in communication with a plurality of air outlets 6 formed in the rear wall 17 of the outer casing 15 through a second air duct 22, is also located in the upper part of the outer casing 15 in a position facing the back end 1*b* of the drum 1, such that the air is extracted from inside the drum 1 through said air outlets 6. As best shown in FIG. 6, the air outlets 6 comprise a plurality of perforations in the rear wall 17 of the outer casing 15 facing the back end 1*b* of the drum 1 and located at a level below said rotation axis E.

A swinging unloading door 7 is connected to the front wall 16 of the outer casing 15 by a horizontal hinge 23 located in an upper edge thereof. The unloading door 7 is movable by an actuator (not shown) between an open position (FIG. 3), in which the unloading door 7 allows unloading clothes from inside the drum 1 through the loading and unloading end 1*a*, and a closed position (FIGS. 1 and 2), in which the unloading door 7 is facing the loading and unloading end 1*a* of the drum 1, closing it. Helical fins 14 are fixed on an inner surface of the revolution wall 1*c* of the drum 1.

A loading opening 8, which is in a position facing the loading and unloading end 1*a* of the drum 1, is formed in the unloading door 7, and said loading opening 8 is connected to a clothes loading duct 9 having an end section 24 ending in a loading mouth 10. The loading opening 8 is associated with a second shutter 11 actuated by a second actuator 25 opening and closing the loading opening 8.

FIG. 1 illustrates a suction-assisted loading operation. Control means activate the first actuator 21 to close the drying air intake opening 2 by means of the first shutter 4, activate the second actuator 25 to open the loading opening 8 by means of the second shutter 11, and at the same time start up the suction turbine 5, which creates a suction air flow in the loading duct 9. In this situation, when an operator moves an item of clothing close to the loading mouth 10, said suction air flow pulls the item of clothing towards the loading duct 9 and introduces it into the drum 1, thereby assisting in loading clothes into the drum 1 through said loading mouth 10.

In the drawings, the circulation of air is depicted by means of solid arrows A and the circulation of clothes is depicted by means of hollow arrows R.

For the purpose of moving the clothes loaded inside the drum 1 away from the air outlets 6 during suction-assisted clothes loading, the tumble dryer according to the embodiment shown in FIGS. 1, 2 and 3 comprises control means in connection with the rotation driving means rotating the drum 1 at a speed equal to or greater than 1 G while the clothes are loaded into the drum 1 by the suction-assisted loading device.

Thus, as the clothes enter the drum 1, they adhere to the inner surface of the revolution wall 1*a* of the drum 1 due to the effect of the rotation thereof at said speed equal to or greater than 1 G, and the clothes do not accumulate in the lower part against the air outlets 6 located at a level below the rotation axis E, whereby the air outlets 6 are clear allowing the suction turbine 5 to extract air from inside the drum 1 through the air outlets 6 and create the corresponding suction air flow in the loading duct 9 during the entire suction-assisted loading operation.

As shown in FIG. 2, once the clothes are loaded into the drum 1, control means activate the first actuator 21 to open the drying air intake opening 2 by means of the first shutter 4 and activate the second actuator 25 to close the loading opening 8 by means of the second shutter 11 while the suction turbine 5 continues operating, which creates a drying air flow between the drying air inlet 3 and the air outlets 6 through the inside of the drum.

During the drying operation, the control means and the rotation driving means rotate the drum 1 at a speed less than 1 G suitable for the clothes to tumble on the lower part of the inside of the drum 1 during drying. Likewise, the rotation direction of the drum is the direction that is suitable for the action of the helical fins 14 to compensate for the tendency of the clothes to move towards the back end 1*b* of the drum 1 as a result of the thrust caused by the axial drying air flow.

Given that the air outlets 6 are located at a level below the rotation axis E of the drum 1, the axial drying air flow created inside the drum 1 by the suction turbine 5 during drying is forced through the clothes being dried, tumbling on the lower part of the revolution wall 1*a* of the drum 1, which assures a high drying efficiency.

FIG. 3 illustrates an automatic clothes unloading operation for unloading clothes from inside the drum 1. To that end, when the drying operation has ended, an actuator (not shown) controlled by the control means moves the unloading door 7 from the closed position to the open position. The loading duct 9 moves with the unloading door 8, whereas the end section 24 of the loading duct 9, which is movably installed in an auxiliary protective casing 26 fixed to a front casing 15*a* covering the front wall 16 of the outer casing 15 and the unloading door 7, moves towards a retracted position so as to not interfere with the loading duct 9, as explained in further detail below.

Once the unloading door 7 is in the open position, the control means and the rotation driving means rotate the drum 1 at a speed less than 1 G and in the opposite rotation direction, which is the direction suitable for the action of the helical fins 14 to pull the clothes towards the loading and unloading 1*a* of the drum 1 in cooperation with the inclination of the latter to unload the clothes from inside the drum 1 through the unloading door 7 and of a lower opening of the front casing 15*a*.

Figure 4:
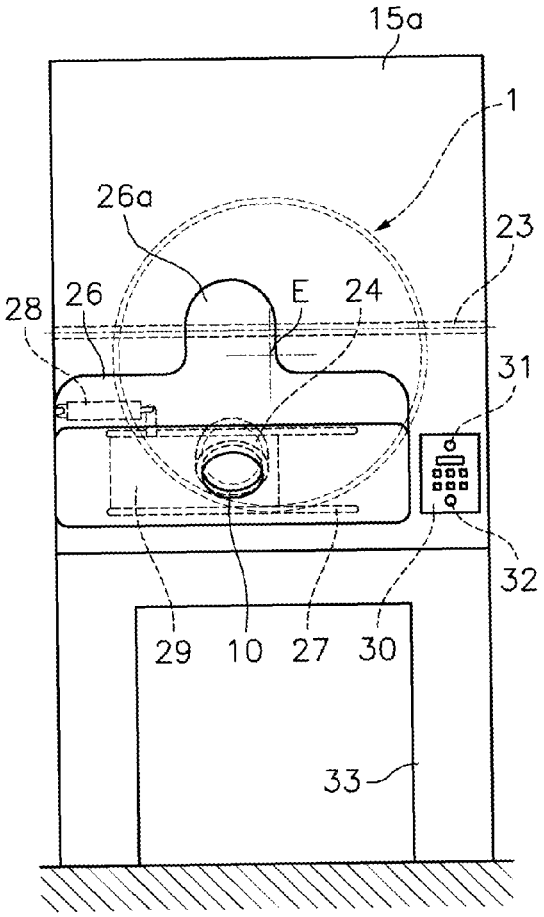
FIG. 4 is a front view of the tumble dryer of FIG. 1 with an unloading door in a closed position.
Figure 5:
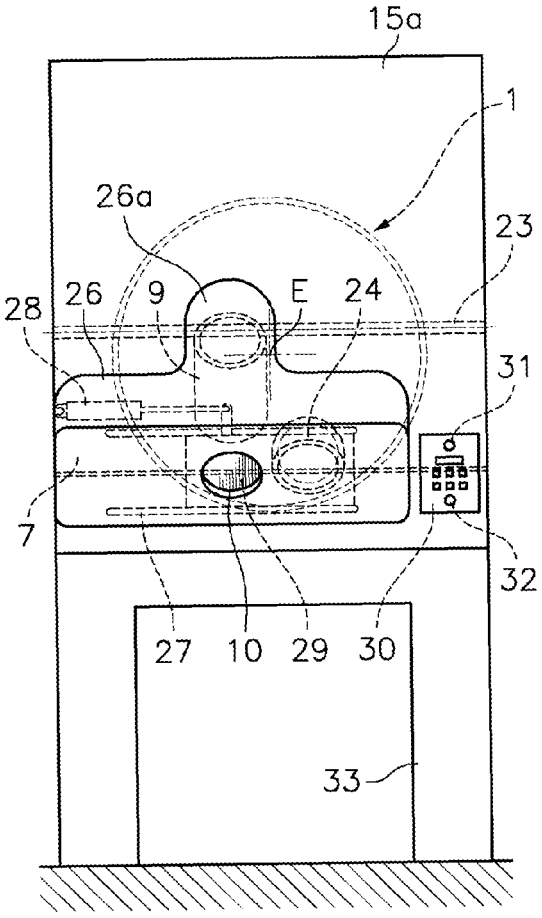
FIG. 5 is a front view of the tumble dryer of FIG. 1 with the unloading door in the open position.

As best shown in FIGS. 4 and 5, the loading mouth 10 is formed in the auxiliary protective casing 26 and the end section 24 of the loading duct 9 is connected to the auxiliary protective casing 26 by horizontal guides 27. A third actuator 28 is operatively connected to move the end section 24 between an operating position (FIGS. 1 and 4), in which the end section 24 communicates the loading mouth 10 with the loading duct 9, and said retracted position (FIGS. 2, 3 and 5), in which the end section 24 is moved away from the loading mouth 10 and the loading duct 9 enough so as to not interfere with the loading duct 9 when the unloading door 7 is moved from the closed position to the open position.

The end section 24 of the loading duct 9 is attached to a closure plate 29 which moves together with said section. The closure plate 29 is sized such that it is concealed in the auxiliary protective casing 26 when the end section 24 of the loading duct 9 is in the operating position (FIG. 4) and closes the loading mouth 10 when the end section 24 of the loading duct 9 is in the retracted position (FIG. 5). The auxiliary protective casing 26 has an oversized region 26*a* for housing the loading duct 9 when the unloading door 7 is in the open position (FIGS. 3 and 5).

When the unloading door 7 is in the closed position (FIGS. 1, 2 and 4), the end section 24 of the loading duct 9 can be moved again to the operating position such that it connects automatically with the loading duct 9, and sealing means provided for such purpose establish a relative tightness between both. As an additional safety measure, the tumble dryer has a control panel 30 (FIGS. 4 and 5) with two separate unloading opening buttons 31, 32 which must be pushed by the operator with both hands to command an unloading operation for the purpose of keeping his/her hands away from the loading mouth 10.

The loading opening 8 is in a position very close to the lower part of the revolution wall 1*a* of the drum 1 and the loading duct is straight. When the unloading door 7 is closed, the loading duct 9 adopts a horizontal or close to horizontal position. The end section 24 of the loading duct 9 forms a slight bend, and the loading mouth is inclined approximately 45 degrees with respect to the vertical, such that the entrance of clothes into the drum 1 through the loading mouth 10, loading duct 9 and loading opening 8 is very direct and virtually free of bends and/or tapers. Furthermore, the pressure which the suction turbine 5 must overcome due to the difference in height of the loading mouth 10 and the loading opening 8 is virtually inexistent.

The tumble dryer is installed on a support structure 33 leaving the front casing 15*a* and the auxiliary protective casing 26 projecting at a height above the ground that is enough to allow placing a cart 34 with wheels under them. Thus, during the suction-assisted loading operation the operator places the cart 34 under the loading mouth 10 to help in feeding the clothes from the cart 34 into the loading mouth 10 (FIG. 1).

Once the suction-assisted loading operation has ended, the operator places the cart 34 under the lower opening of the front casing 15*a* and gives a command to start the drying operation by means of the control panel 30, after which the tumble dryer requires no further action from the operator. When the drying operation has ended, the unloading door 7 is automatically opened and the automatic clothes unloading operation for unloading clothes from inside the drum 1 into the cart 34 begins (FIG. 3).

Figure 7:
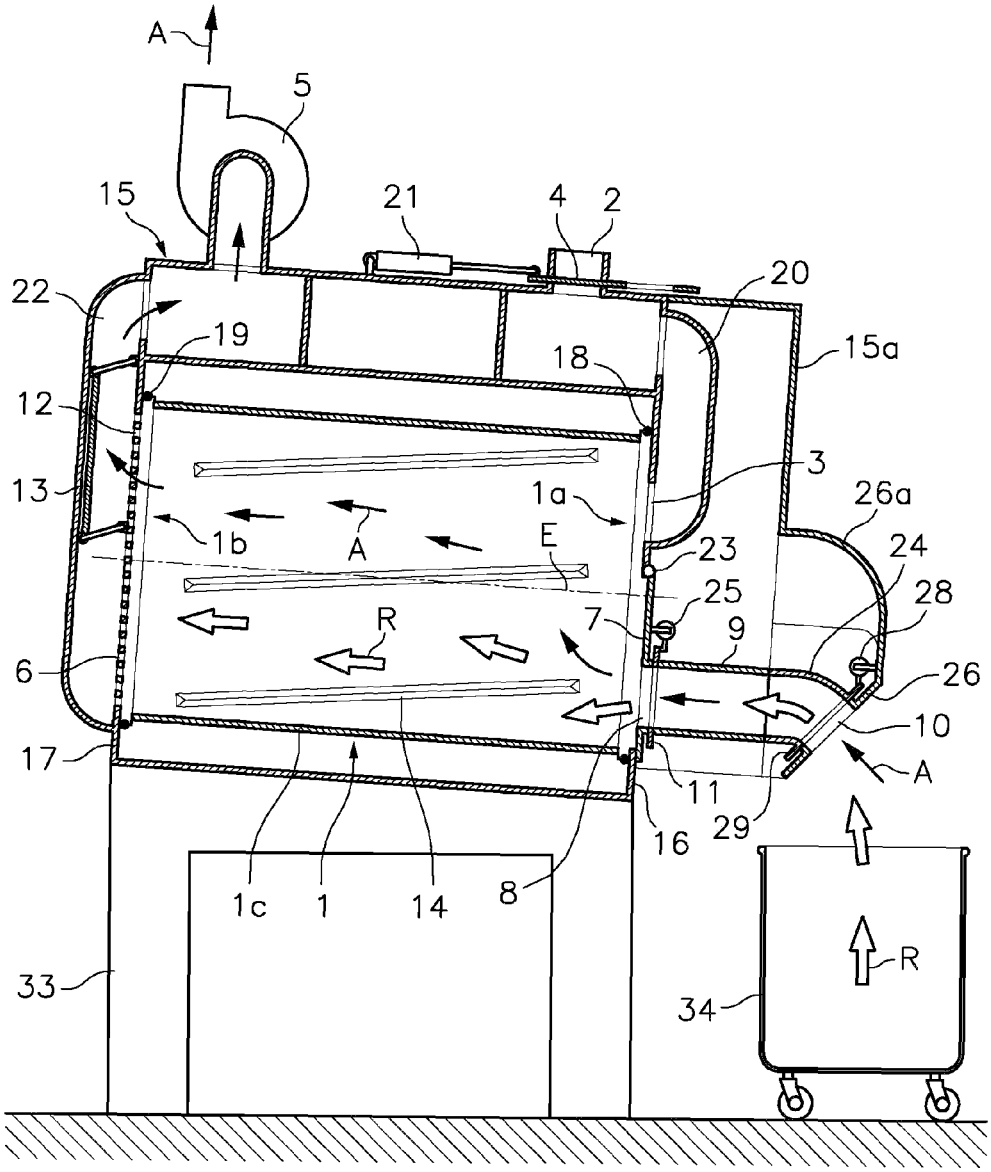
FIG. 7 is a schematic sectioned side view of a tumble dryer with a suction-assisted loading device according to another embodiment of the present invention during a suction-assisted clothes loading operation.
Figure 8:
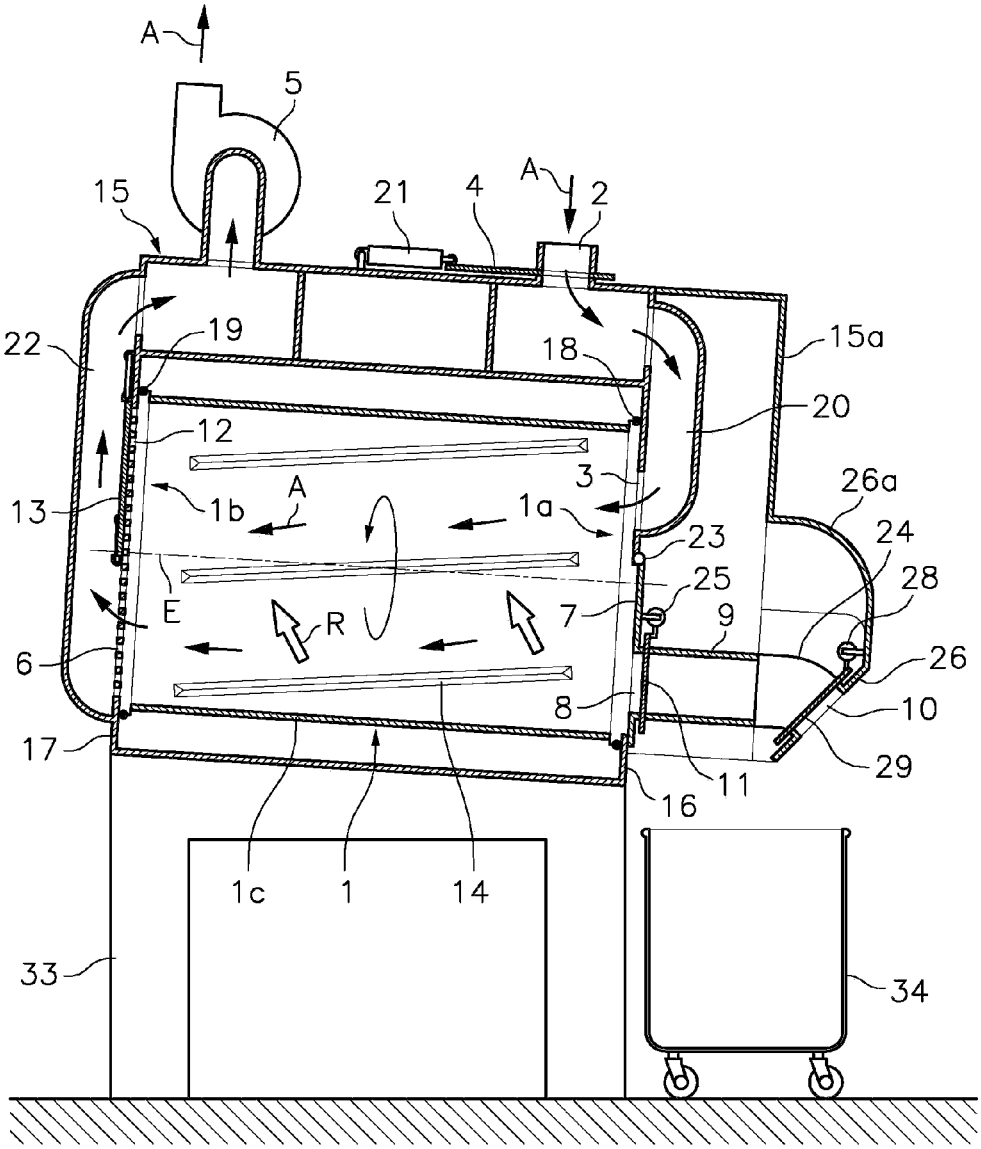
FIG. 8 is a schematic sectioned side view of the tumble dryer of FIG. 7 during a drying operation.

FIGS. 7 and 8 show another embodiment of the tumble dryer of the present invention which is similar in all aspects to that described above in relation to FIGS. 1 to 3, with the exception that the tumble dryer of FIGS. 7 and 8 has means for temporarily providing an auxiliary air exit in communication with the suction turbine 5, in addition to the air outlets 6, during suction-assisted clothes loading to assure a suction air flow that is enough to entrain the clothes from the loading mouth 10 into the drum 1.

These means for providing an auxiliary air exit during suction-assisted clothes loading comprise a plurality of auxiliary air outlets 12 facing the back end 1*b* of the drum 1 and located at a level above the rotation axis E. In the illustrated embodiment, this plurality of auxiliary air outlets 12 are perforations formed in the rear wall 17 of the outer casing 15, such that the rear wall 17 has perforations covering substantially the entire area of the back end 1*b* of the drum 1.

The auxiliary air outlets 12 are in communication with the suction turbine 5 through the second air duct 22, and a third shutter 13, which is actuated by a corresponding actuator (not shown), is arranged for opening and closing the communication between the auxiliary air outlets 12 and the suction turbine 5.

FIG. 7 shows the tumble dryer during a suction-assisted loading operation, where the first shutter 4 is closed preventing the intake of drying air through the drying air intake opening 2 and the entry of air into the drum 1 through the drying air inlet 3, the second shutter 11 is open allowing the entry of air into the drum 1 through the loading duct 9 and the loading opening 8, and said third shutter 13 is open such that both the air outlets 6 located at a level below the rotation axis E and the auxiliary air outlets 12 located at a level above the rotation axis E are in communication with the suction turbine 5.

In this case, the suction-assisted clothes loading operation can be performed with the drum 1 stopped, since the large air outlet area provided jointly by the air outlets 6 and the auxiliary air outlets 12 assures that the speed of the suction air flow inside the loading duct 9 is high enough to pull the items of clothing into the drum 1 but that the speed of the suction air flow through the air outlets 6 and auxiliary air outlets 12 is relatively low and not enough to pull the items of clothing that are already inside the drum 1 on the lower part of the revolution wall 1*c* to the rear wall 17 of the outer casing 15 where the air outlets 6 are located, with a low risk that they will be covered.

Even if one of the items of clothing is pulled by the suction air flow along the lower part of the revolution wall 1*c* of the drum 1 and eventually shutters the air outlets 6 located at a level below the rotation axis E, the auxiliary air outlets 12 located at a level above the rotation axis E would still be clear, thereby assuring a suction air flow that is enough to entrain the clothes from the loading mouth 10, along the loading duct 9, and into the drum 1.

FIG. 8 shows the tumble dryer during a drying operation, where the first shutter 4 is open allowing the intake of drying air through the drying air intake opening 2 and the entry of air into the drum 1 through the drying air inlet 3, the second shutter 11 is closed preventing the entry of air into the drum 1 through the loading duct 9 and the loading opening 8, and the third shutter 13 is in a closed position preventing the exit of drying air through the auxiliary air outlets 12 located at a level above the rotation axis E, such that the exit of drying air is only through the air outlets 6 located at a level below the rotation axis E.

Thus, during the drying operation, the working and the features of the tumble dryer according to the embodiment shown in FIGS. 7 and 8 are identical to those the of the tumble dryer described above in relation to FIGS. 1, 2 and 3. In the tumble dryer shown in FIGS. 7 and 8, the automatic unloading operation (not shown) is also performed similarly to that described above in relation to FIG. 3.

Figure 9:
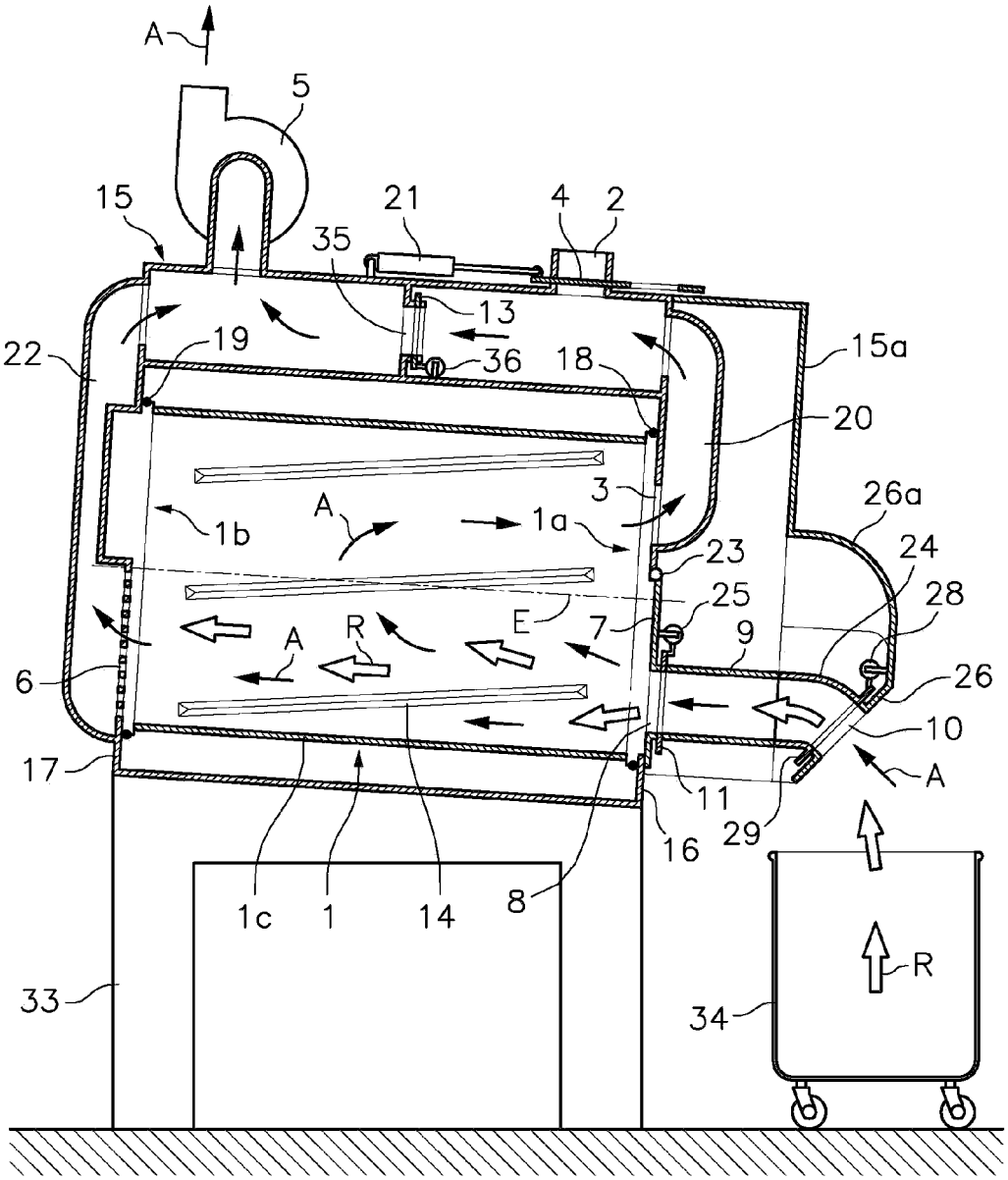
FIG. 9 is a schematic sectioned side view of a tumble dryer with a suction-assisted loading device according to yet another embodiment of the present invention during a suction-assisted clothes loading operation.
Figure 10:
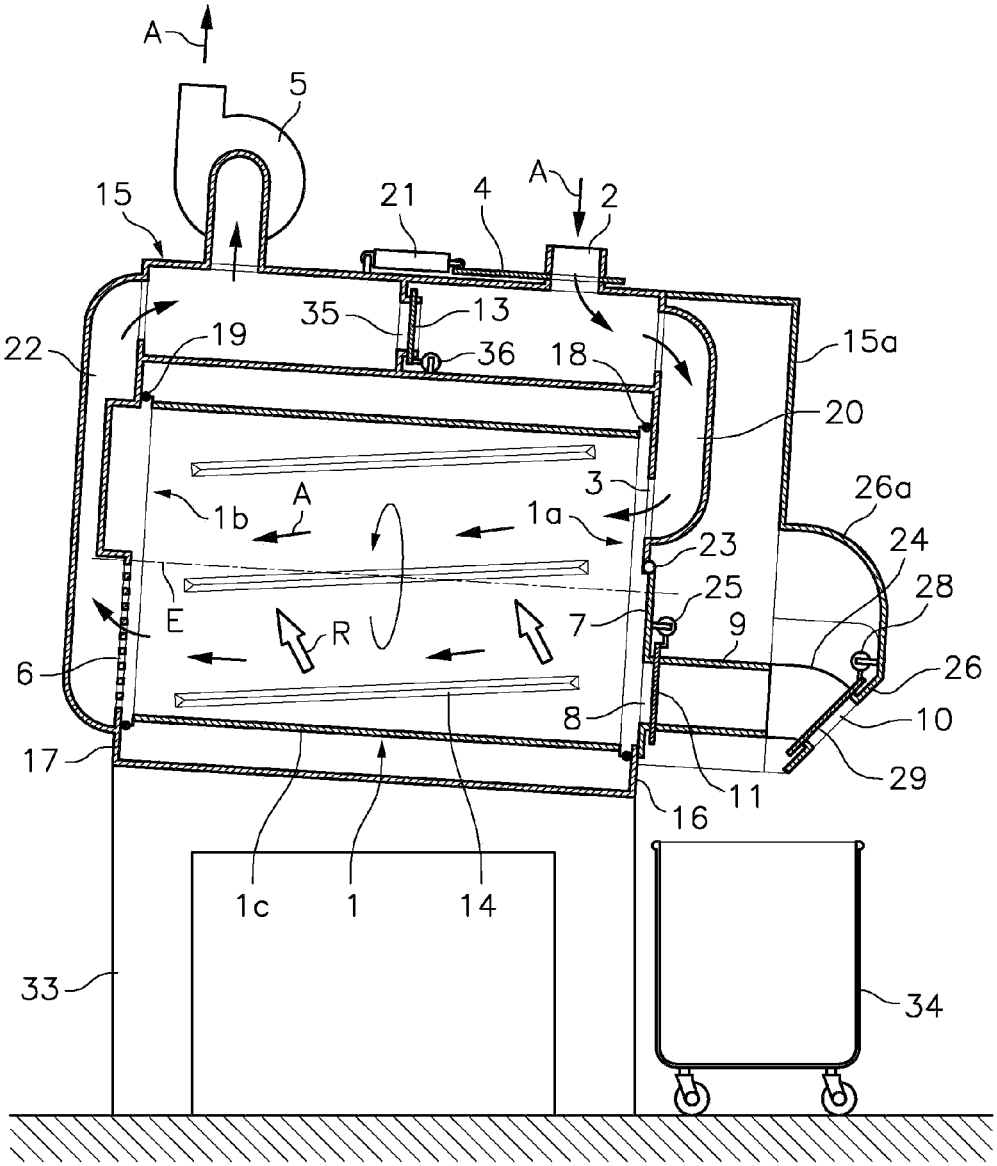
FIG. 10 is a schematic sectioned side view of the tumble dryer of FIG. 9 during a drying operation.

FIGS. 9 and 10 show a tumble dryer according to yet another embodiment of the present invention, which is similar in all aspects to that described above in relation to FIGS. 1 to 3, with the exception that the tumble dryer of FIGS. 9 and 10 has, like the tumble dryer of FIGS. 7 and 8, means for temporarily providing an auxiliary air exit in communication with the suction turbine 5, in addition to the air outlets 6, during suction-assisted clothes loading.

More particularly, the tumble dryer shown in FIGS. 9 and 10 has a communication opening 35 communicating the drying air inlet 3 with the suction turbine 5 via communication between the first and second air ducts 20, 22. Here, the third shutter 13 arranged for opening and closing the mentioned communication between the drying air inlet 3 and the suction turbine 5 under the actuation of a fourth actuator 36.

As shown in FIG. 9, during the suction-assisted clothes loading operation, the first shutter 4 is closed preventing the intake of drying air through the drying air intake opening 2 and the entry of air into the drum 1 through the drying air inlet 3, the second shutter 11 is open allowing the entry of air into the drum 1 through the loading duct 9 and the loading opening 8, and the third shutter 13 is open such that both the air outlets 6 located at a level below the rotation axis E and the drying air inlet 3 are in communication with the suction turbine 5.

This allows using the drying air inlet 3 as the auxiliary air outlet when the first shutter 4 is closed and the third shutter 13 is open, providing features during the suction-assisted clothes loading operation that are similar to those of the tumble dryer according to the embodiment shown in FIGS. 7 and 8.

FIG. 10 shows the tumble dryer during a drying operation, where the first shutter 4 is open allowing the intake of drying air through the drying air intake opening 2 and the entry of air into the drum 1 through the drying air inlet 3, the second shutter 11 is closed preventing the entry of air into the drum 1 through the loading duct 9 and the loading opening 8, and the third shutter 13 is closed preventing the exit of drying air through the drying air inlet 3, such that the exit of drying air is only through the air outlets 6 located at a level below the rotation axis E.

Thus, during the drying operation shown in FIG. 10, the working and the features of the tumble dryer are identical to those of the tumble dryer described above in relation to FIGS. 1, 2 and 3. In the tumble dryer shown in FIGS. 9 and 10, the automatic unloading operation (not shown) is also performed similarly to that described above in relation to FIG. 3.

In relation to FIGS. 11, 12 and 13, sealing gaskets 18, 19 according to different embodiments of the present invention will now be described. In all the embodiments, the sealing gaskets 18, 19 of the present invention are made of a textile material, such as polyester for example, with an aramide coating, such as a NOMEX® coating for example, at least on the face subjected to friction. With this composition, the sealing gaskets 18, 19 have low friction and excellent wear resistance in friction contact with the metallic material, stainless steel for example, of which the drum 1, casing 15 or unloading door 7 are made.

Figure 11:
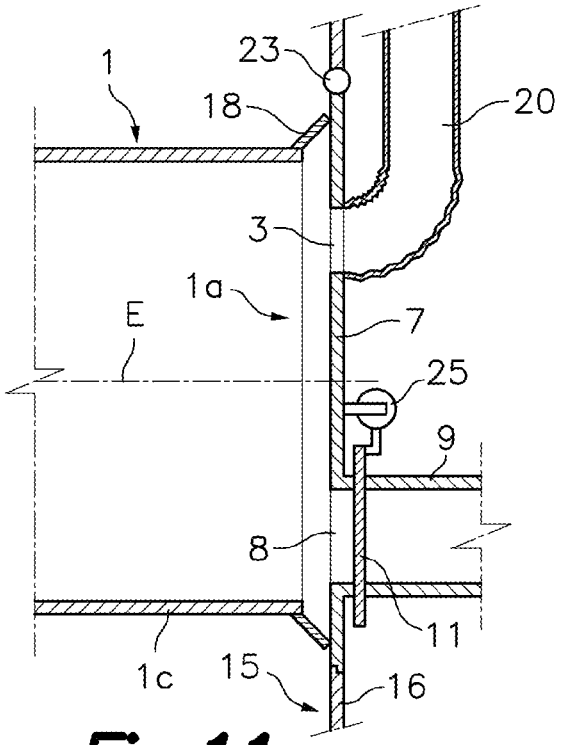
FIG. 11 is a is a schematic sectioned partial view illustrating an embodiment of a sealing gasket between the loading and unloading end of the drum and an unloading door installed in the front wall of the outer casing.

FIG. 11 shows an embodiment of the sealing gasket 18 between the loading and unloading end 1*a* of the revolution wall 1*c* of the drum 1 and the unloading door 7, which is installed in the front wall 16 of the outer casing 15. In this embodiment, the unloading door is connected to the front wall 16 of the outer casing 15 by a horizontal hinge 23 located in an upper edge thereof and spanning the entire perimeter of the loading and unloading end 1*a* of the drum 1. The air inlet 3 is accordingly formed in the unloading door and the first air duct 20 is a flexible duct. Alternatively, the first air duct 20 could be rigid and decoupled when the unloading door 7 is opened.

The sealing gasket 18 of FIG. 11 is in the form of a frustoconical annular strip having an edge with a smaller diameter fixed to the loading and unloading end 1*a* of the revolution wall 1*c* of the drum 1 and a free end with a larger diameter in friction contact with the unloading door. The edge with a smaller diameter of the sealing gasket 18 connected to the drum 1 is located further inside the drum 1 than the free edge which is in contact with the unloading door.

An advantage of the sealing gasket 18 of FIG. 11 is that during use, the external pressure, which is greater than the pressure inside the drum 1 due to the effect of the suction air flow created by the suction turbine 5, tends to press the free edge of the sealing gasket 18 against the inner surface of the unloading door 7, improving tightness. Furthermore, the frustoconical construction helps the sealing gasket 18 to be relaxed when the unloading door 7 is opened and to again become tensed when the unloading door 7 is closed. Nevertheless, alternatively the frustoconical sealing gasket 18 is also useful for working permanently against a stationary wall.

Figure 12:
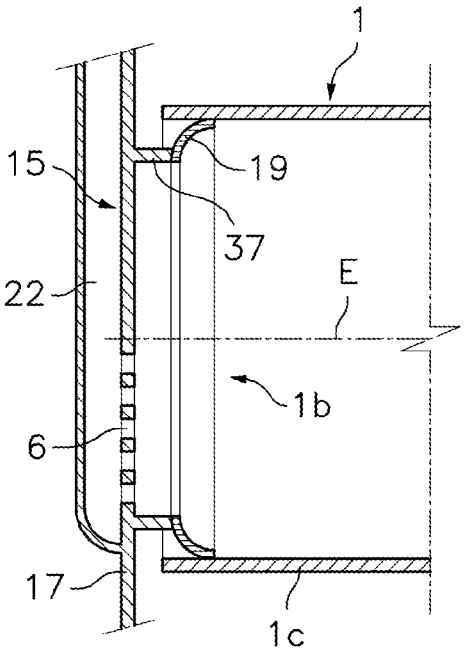
FIGS. 12 and 13 are schematic sectioned partial views illustrating two different embodiments of the sealing gasket between the back end of the drum and the rear wall of the outer casing.

FIG. 12 shows an embodiment of the sealing gasket 19 between the back end 1*b* of the revolution wall 1*c* of the drum 1 and the rear wall 17 of the outer casing 15. The sealing gasket 19 is in the form of an externally concave annular strip fixed to an annular member 37 extending into the back end 1*b* of the drum 1 from the rear wall 17, such that a free edge of the sealing gasket 19 makes friction contact with the inner surface of the revolution wall 1*c* of the drum 1. The edge of the sealing gasket 19 connected to the annular member has a smaller diameter and is further out of the drum 1 than the free edge that is in contact with the drum 1.

Figure 13:
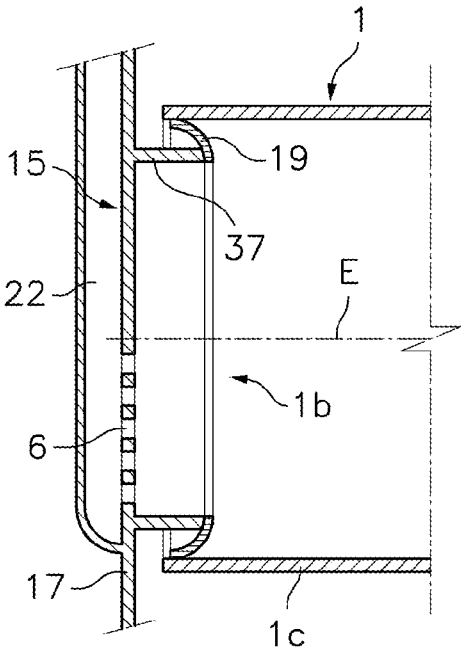

FIG. 13 shows another embodiment of the sealing gasket 19 between the back end 1*b* of the revolution wall 1*c* of the drum 1 and the rear wall 17 of the outer casing 15, where the sealing gasket 19 is in the form of an externally convex annular strip also fixed to an annular member 37 extending into the back end 1*b* of the drum 1 from the rear wall 17, such that a free edge of the sealing gasket 19 makes friction contact with the inner surface of the revolution wall 1*c* of the drum 1. The edge of the sealing gasket 19 connected to the annular member has a smaller diameter and is further inside the drum 1 than the free edge that is in contact with the drum 1.

An advantage of the sealing gasket 19 of FIG. 13 is that during use, the external pressure, which is greater than the pressure inside the drum 1 due to the effect of the suction air flow created by the suction turbine 5, tends to press the free edge of the sealing gasket 19 against the inner surface of the revolution wall 1*c* of the drum 1, improving tightness. Nevertheless, alternatively the externally concave sealing gasket 19 is also useful for working against an unloading door 7 such as that shown in FIG. 11, which can be open and closed.

A person skilled in the art will readily think of modifications and variations with respect to the embodiments shown and described without departing from the scope of the present invention as it is defined in the attached claims.

The invention claimed is:

1. A tumble dryer with a suction-assisted loading device, comprising:

a rotary drum (1) provided with a revolution wall (1*c*), an open loading and unloading end (1*a*), and a back end (1*b*) opposite said loading and unloading end (1*a*);

rotation driving means for rotating said drum (1) around a horizontal or slightly inclined rotation axis (E);

at least one drying air intake opening (2) in communication with at least one drying air inlet (3) for entering air into the drum (1);

a first shutter (4) for opening and closing the communication between said drying air intake opening (2) and said drying air inlet (3);

a suction turbine (5) in communication with a plurality of air outlets (6) for extracting air from the drum (1);

an unloading door (7) that is movable between an open position and a closed position facing said loading and unloading end (1*a*) of the drum (1);

a loading opening (8) formed in said unloading door (7) in a position facing the loading and unloading end (1*a*) of the drum (1);

a loading duct (9) connected to said loading opening (8) and provided with a loading mouth (10);

a second shutter (11) for opening and closing said loading opening (8); and means for closing said first shutter (4) and opening said second shutter (11) while said suction turbine (5) is operating to create a suction air flow in said loading duct (9) which assists in loading clothes into the drum (1) through said loading mouth (10);

said revolution wall (1*c*) of the drum (1) is a non-perforated revolution wall and said back end (1*b*) is open;

said at least one drying air inlet (3) is facing the loading and unloading end (1*a*) of the drum (1) and said air outlets (6) are facing the back end (1*b*) of the drum (1) and are located at a level below said rotation axis (E) in the back end (1*b*), such that during drying, the suction turbine (5) creates a drying air flow in a substantially axial direction inside the drum (1);

and in that it further comprises means for moving the clothes loaded inside the drum (1) away from the air outlets (6) during suction-assisted clothes loading and/or means for temporarily providing an auxiliary air exit in communication with the suction turbine (5) in addition to the air outlets (6) during suction-assisted clothes loading to assure a suction air flow that is enough to entrain the clothes from the loading mouth (10) into the drum (1).

2. The tumble dryer according to claim 1, wherein said means for moving the clothes loaded inside the drum (1) away from the air outlets (6) during suction-assisted clothes loading comprise control means in connection with said rotation driving means for rotating the drum (1) at a speed equal to or greater than 1 G during suction-assisted clothes loading.

3. The tumble dryer according to claim 1, wherein said means for providing an auxiliary air exit during suction-assisted clothes loading comprise at least one auxiliary air outlet in communication with the suction turbine (5) and facing the loading and unloading end (1*a*) and/or the back end (1*b*) of the drum (1), a third shutter (13) for opening and closing the communication between said auxiliary air outlet and the suction turbine (5), and means for opening said third shutter (13) during suction-assisted clothes loading and for closing the third shutter (13) during drying.

4. The tumble dryer according to claim 3, wherein said auxiliary air outlet is at least one auxiliary air outlet (12) facing the back end (1*b*) of the drum (1) and located at a level above the rotation axis (E).

5. The tumble dryer according to claim 3, wherein the third shutter (13) is arranged for opening and closing a communication between the drying air inlet (3) and the suction turbine (5), which allows using the drying air inlet (3) as said auxiliary air outlet when the first shutter (4) is closed and the third shutter (13) is open.

6. The tumble dryer according to claim 1, wherein said revolution wall (1*c*) has internal helical fins (14), and control means are connected with said rotation driving means for rotating the drum (1) in a suitable direction so that said helical fins (14) pull the clothes inside the drum (1) towards the loading and unloading end (1*a*) when the unloading door (7) is in said open position during unloading of clothes from inside the drum (1).

7. The tumble dryer according to claim 6, wherein the rotation axis (E) is slightly inclined with respect to the horizontal such that the loading and unloading end (1*a*) of the drum (1) is at a lower level than the back end (1*b*).

8. The tumble dryer according to claim 7, characterized wherein the revolution wall (1*c*) of the drum (1) is frustoconical or approximately frustoconical, and a generatrix of the revolution wall (1*c*) in the lowest position of the drum (1) has its end adjacent to the loading and unloading end (1*a*) of the drum (1) at a lower level than its end adjacent to the back end (1*b*) of the drum (1).

9. The tumble dryer according to claim 6, wherein the revolution wall (1*c*) of the drum (1) is frustoconical or approximately frustoconical, and a generatrix of the revolution wall (1*c*) in the lowest position of the drum (1) has its end adjacent to the loading and unloading end (1*a*) of the drum (1) at a lower level than its end adjacent to the back end (1*b*) of the drum (1).

10. The tumble dryer according to claim 1, wherein the loading opening (8) is in a position close to the lower part of the revolution wall (1*a*) of the drum (1), and the loading duct (9) is substantially straight and adopts a horizontal or close to horizontal position when the unloading door (7) is closed.

11. The tumble dryer according to claim 1, wherein the loading duct (9) moves with the unloading door (7), the loading mouth (10) is formed in an auxiliary protective casing (26) fixed to an outer casing (15), and the loading duct (9) has an end section (24) installed in said auxiliary protective casing (26) such that it is movable between an operating position in which said end section (24) communicates the loading mouth (10) with the loading duct (9) when the unloading door (7) is in the closed position, and a retracted position in which the end section (24) is moved away from the loading mouth (10) and from the loading duct (9) enough so as to not interfere with the loading duct (9) when the unloading door (7) is moved to its open position.

* * * * *